US006300605B1

(12) United States Patent
Higgins

(10) Patent No.: US 6,300,605 B1
(45) Date of Patent: Oct. 9, 2001

(54) RADIANT ELECTRIC HEATER

(75) Inventor: George Anthony Higgins, Hagley (GB)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 09/822,133

(22) Filed: Mar. 30, 2001

(30) Foreign Application Priority Data

Apr. 3, 2000 (GB) ..... 0008028

(51) Int. Cl.[7] ..... H05B 3/68

(52) U.S. Cl. ..... 219/448.11; 219/448.19; 219/460.1; 219/462.1

(58) Field of Search ..... 219/443.1, 445.1, 219/446.1, 448.14, 448.18, 448.19, 458.1, 460.1, 462.1; 126/39 BA, 39 G, 39 H, 39 J, 90 A, 92 A

(56) References Cited

U.S. PATENT DOCUMENTS

| | | | | |
|---|---|---|---|---|
| 4,350,875 | * | 9/1982 | McWilliams | 219/462.1 |
| 5,498,854 | * | 3/1996 | McWilliams | 219/462.1 |
| 5,977,523 | * | 11/1999 | Scott | 219/462.1 |
| 6,018,149 | * | 1/2000 | Higgins | 219/462.1 |

FOREIGN PATENT DOCUMENTS 2339376 1/2000 (GB) .

OTHER PUBLICATIONS

Search Report Aug. 30, 2000.

* cited by examiner

*Primary Examiner*—Sang Paik
(74) *Attorney, Agent, or Firm*—Ira S. Dorman

(57) ABSTRACT

A radiant electric heater comprises a base (3) of thermal insulation material having supported thereon or adjacent thereto at least two concentrically-arranged heating elements (7, 9) separated by a dividing wall (5) of thermal insulation material to form an outer heating zone (8) and an inner heating zone (6), the heater having a peripheral wall (4) of thermal insulation material. A tunnel (11) formed of thermal insulation material extends between the peripheral wall and the dividing wall across the outer heating zone such that heating element or elements of the outer heating zone are substantially absent from an area occupied by the tunnel. A rod-like temperature-responsive device (10) extends from a periphery of the heater through the tunnel (11) and at least partly across the inner heating zone (6), through an aperture provided in the dividing wall (5). One or more portions of one or more heating elements (7) of the inner heating zone extend into the tunnel. Ventilation means (18, 20, 21, 23, 24) is provided for the tunnel (11) intermediate the ends thereof to reduce temperature within the tunnel to a desired level.

20 Claims, 3 Drawing Sheets

RADIANT ELECTRIC HEATER

The present invention relates to radiant electric heaters, such as for use in cooking appliances and especially for use in cooking appliances having glass-ceramic cooking surfaces.

DESCRIPTION OF PRIOR ART

It is well known to provide a radiant electric heater for use in a cooking appliance beneath a glass-ceramic cooking surface and in which at least two concentrically-arranged heating elements, separated by a dividing wall of thermal insulation material, are supported on or adjacent to a base of thermal insulation material, such as microporous thermal and electrical insulation material. An outer heating zone and an inner heating zone are thereby provided, the inner heating zone having one or more heating elements which are generally arranged to be energisable independently of the heating element or elements of the outer heating zone.

A peripheral wall of thermal insulation material is generally arranged around the edge of the heater and a rod-like temperature-responsive device extends from a periphery of the heater across the heater to a position at least partly across the inner heating zone.

In order to meet a requirement that the temperature-responsive device should be responsive substantially only to heat from the inner heating zone, even when both inner and outer heating zones are energised, it is known to provide a tunnel of thermal insulation material covering the rod-like temperature-responsive device in the outer heating zone between the peripheral wall and the dividing wall. The heating element in the outer heating zone is arranged to stop short of the tunnel at either side thereof and hence do not intrude into the tunnel. The temperature-responsive device is thus thermally isolated from the heating element in the outer heating zone.

It is further known to provide one or more portions of the heating element of the inner heating zone extending into the tunnel through an aperture in the dividing wall. It has been found expedient to lead such one or more portions of the heating element through the tunnel to a terminal region, or terminal block, at the edge of the heater for electrically connecting the element of the inner heating zone to a power supply. Although the provision of the portion or portions of the heating element passing through the tunnel enables the rod-like temperature-responsive device to be influenced by heat from the element of the inner heating zone over substantially its entire length, a problem can arise in that overheating can occur in the portion or portions of the heating element inside the tunnel. Although the problem applies to all forms of heating elements, it has become particularly apparent with heating elements in the form of corrugated ribbon material, with a risk of premature failure of the portion or portions of an element of such material inside the tunnel. The temperature of the portion or portions inside the tunnel may reach a level about 20 to 50 degrees Celsius higher than the highest temperature in the body of the heater.

OBJECT OF THE INVENTION

It is an object of the present invention to overcome or minimise this problem.

SUMMARY OF THE INVENTION

According to the present invention there is provided a radiant electric heater comprising:

a base of thermal insulation material having supported relative (on or adjacent) thereto at least two concentrically-arranged heating elements separated by a dividing wall of thermal insulation material to form an outer heating zone and an inner heating zone, the heater having a peripheral wall of thermal insulation material;

a tunnel formed of thermal insulation material extending between the peripheral wall and the dividing wall across the outer heating zone and such that the at least one heating element of the outer heating zone is substantially absent from an area occupied by the tunnel;

a rod-like temperature-responsive device extending from a periphery of the heater through the tunnel and at least partly across the inner heating zone, through an aperture provided in the dividing wall;

at least one portion of at least one heating element of the inner heating zone extending into the tunnel; and ventilation means provided for the tunnel intermediate the ends thereof to reduce temperature within the tunnel to a desired level.

The ventilation means may comprise one or more apertures extending into the tunnel from the outer heating zone.

The one or more apertures may be provided at a base region of side walls of the tunnel.

The tunnel may be of substantially inverted U-shaped cross section and supported on lower edges thereof.

The tunnel may be supported such that one or more apertures is or are provided between the tunnel and the base. The tunnel may be supported on spaced-apart protrusions provided on the base and which may be integral with the base. Alternatively, the tunnel may have one or both lower edges of substantially castellated form. As a further alternative, one or more pedestal regions may be formed by one or more lower regions of the peripheral wall and/or the dividing wall, the tunnel being spaced from the base at one or both ends thereof by the one or more pedestal regions. As a still further alternative, one or more recesses (grooves or holes) may be provided in the base of thermal insulation material extending beneath one or both lower edges of the tunnel.

The tunnel may be integral with the dividing wall and/or the peripheral wall.

The tunnel may comprise bound vermiculite.

The one or more portions of the one or more heating elements of the inner heating zone may extend through the tunnel to a terminal region at the edge of the heater. In this respect, the tunnel may be provided with a laterally-extending portion proximate the peripheral wall to shield the one or more portions of the one or more heating elements in the vicinity of the terminal region.

The one or more heating elements of the inner heating zone may be energisable independently of the heating element or elements of the outer heating zone.

The heating elements may be of ribbon form and may be supported edgewise on the base.

The base may comprise microporous thermal and electrical insulation material.

For a better understanding of the invention and to show more clearly how it may be carried into effect, reference will now be made, by way of example, to the accompanying drawings in which:

DESCRIPTION OF PREFERRED EMBODIMENTS

Figure 1:
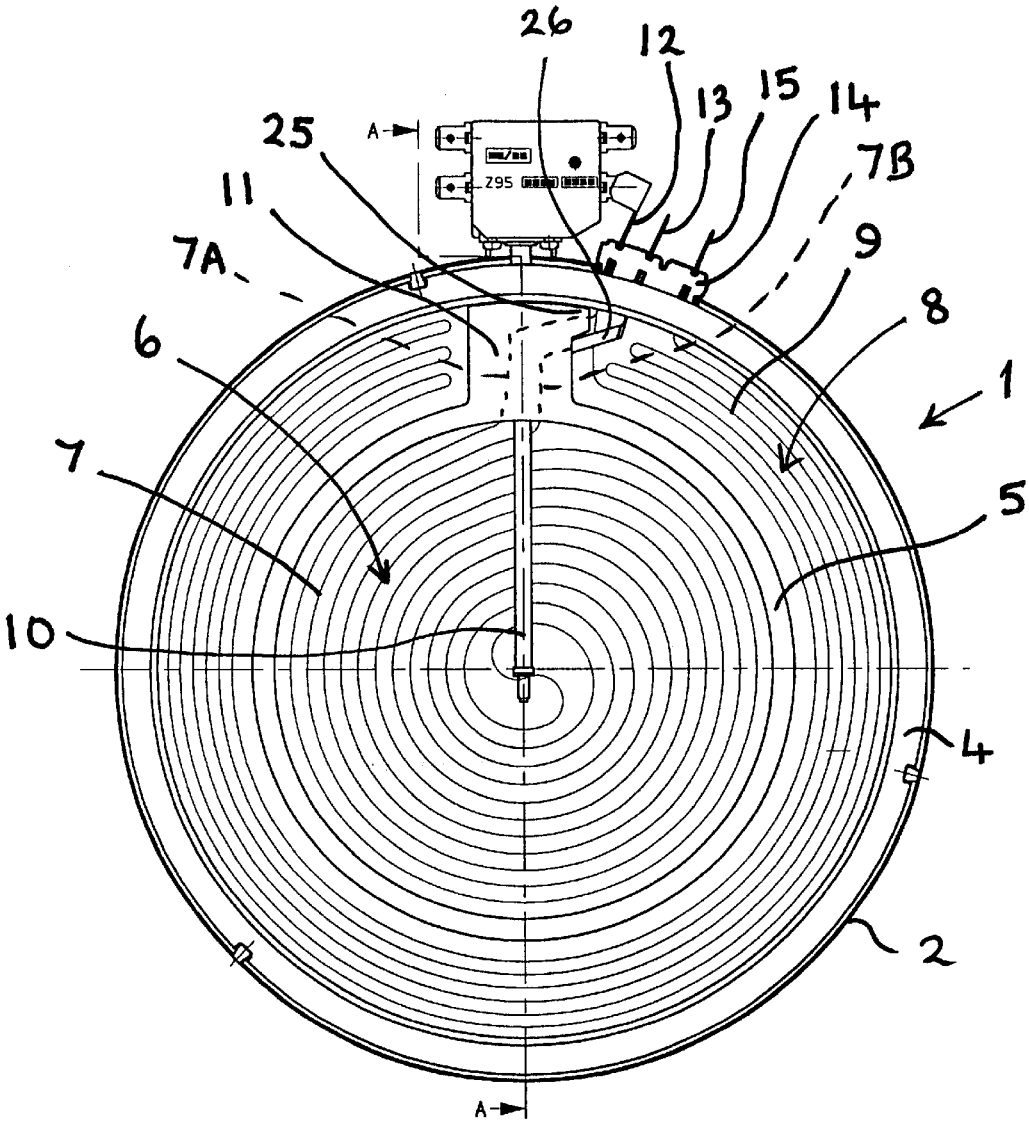
FIG. 1 is a plan view of one embodiment of a radiant electric heater according to the present invention.
Figure 2:
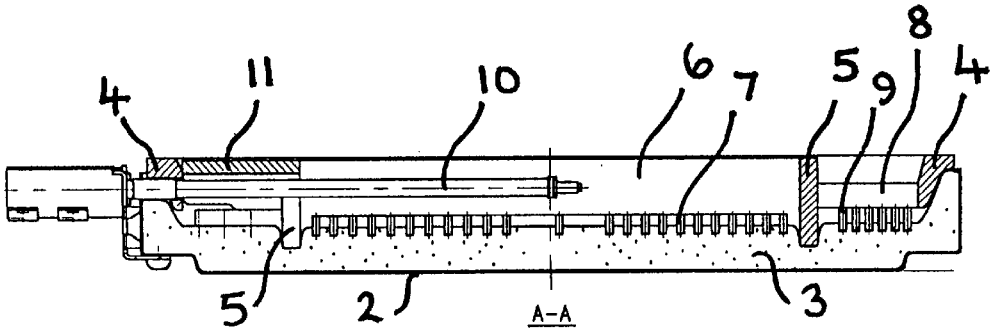
FIG. 2 is a cross-sectional view of the radiant electric heater of FIG. 1.

Referring to FIGS. 1 and 2, a radiant electric heater 1, for use under a glass-ceramic surface (not shown) of a cooking appliance, has a metal support dish 2 containing a base 3 of microporous thermal and electrical insulation material. A peripheral wall 4 of thermal insulation material, such as bound vermiculite, is provided around the outside edge of the heater. Such vermiculite suitably comprises exfoliated particles of vermiculite bound with, for example, potassium silicate.

Two heating zones are provided, separated by a dividing wall 5 of thermal insulation material, such as bound vermiculite. An inner heating zone 6 contains at least one heating element 7, supported on the base 3 and suitably comprising one or more edgewise-mounted corrugated ribbons. An outer heating zone 8 contains at least one heating element 9, of similar form to the heating element 7.

A rod-like temperature-responsive device 10 of well-known form extends across the heater from the periphery thereof and partly across the inner heating zone 6, through an aperture provided in the dividing wall 5.

Figure 6:
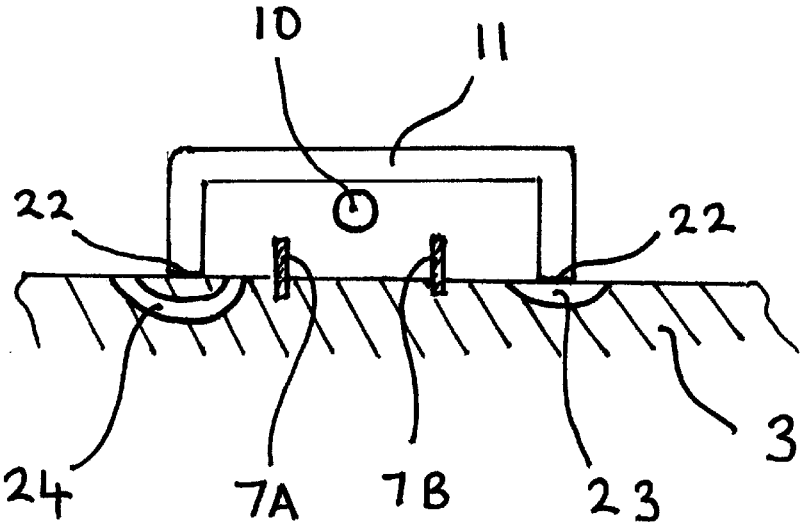
FIG. 6 is a detail showing a cross-sectional view of a still further embodiment of tunnel ventilation means in the radiant electric heater of FIG. 1.

In order that the temperature-responsive device 10 can be made responsive to heat generated only by the one or more heating elements 7 in the inner heating zone 6, even when the one or more heating elements 9 in the outer heating zone 8 is or are energised, a tunnel 11 of thermal insulation material, such as bound vermiculite, is provided. The tunnel 11 is of substantially inverted U-shaped cross-section, such as is shown in FIG. 6, and extends between the peripheral wall 4 and the dividing wall 5, covering the rod-like temperature-responsive device 10 in this region. The one or more heating elements 9 in the outer heating zone 8 is or are arranged to stop short of the tunnel 11. The temperature-responsive device 10 is therefore thermally isolated by the tunnel 11 from the heating element or elements 9 of the outer heating zone 8.

End portions 7A and 7B of the one or more heating elements 7 of the inner heating zone 6 are arranged to pass directly or indirectly through the tunnel 11 and are connected to terminals 12, 13 of a terminal block 14 at the edge of the heater. Terminal regions of the one or more heating elements 9 in the outer heating zone 8 are connected to terminals 12 and 15 of the terminal block 14. By appropriate connection of a power supply (not shown) to the terminals 12, 13, and 15, the inner heating zone 6 can be energised alone, or can be energised together with the outer heating zone 8.

As a result of a tendency for the end portions 7A, 7B of the one or more heating elements 7 to operate at a higher temperature inside the tunnel 11 than the remainder of the element or elements 7 outside the tunnel in the inner heating zone 6, there is a risk of premature failure occurring in these portions 7A, 7B.

In order to minimise or overcome this problem, ventilation means is provided for the tunnel 11 intermediate the ends thereof, details of which are shown in FIGS. 3 to 6.

Figure 3:
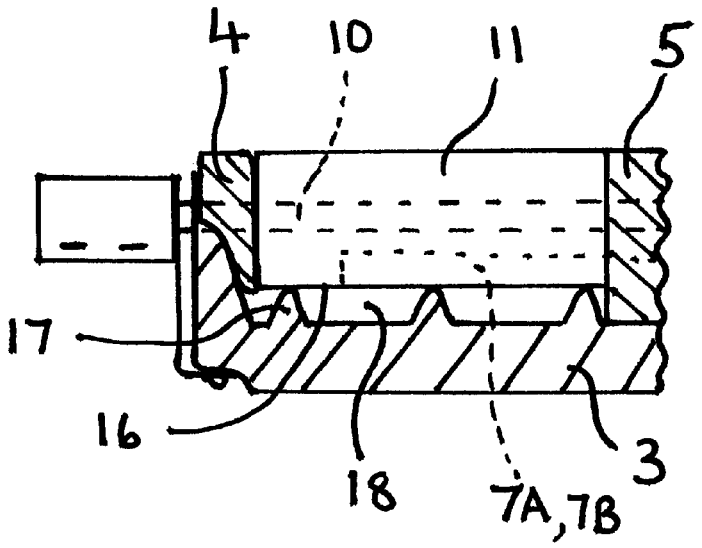
FIG. 3 is a detail showing a part-sectional view of an embodiment of tunnel ventilation means in the radiant electric heater of FIG. 1.

Referring to FIG. 3, the tunnel 11, of inverted U-shaped cross section, extends between the peripheral wall 4 and the dividing wall 5. Lower edges 16 of the tunnel 11 are supported on spaced apart protrusions 17 provided on the base 3 of thermal insulation material so that apertures 18 are provided, between the lower edges 16 of the tunnel 11 and the base 3, through which air can circulate to the interior of the tunnel 11 from the outer heating zone 9, thereby preventing overheating of the portions 7A, 7B of heating element inside the tunnel 11.

The protrusions 17 suitably result in a spacing between the lower edges 16 of the tunnel 11 and the surface of the base 3 of between about 0.3 and 5 mm, preferably between about 0.5 and 3 mm and most preferably between about 1 and 2 mm. The temperature inside the tunnel 11 suitably does not significantly exceed the highest temperature in the body of the heater.

Referring to FIG. 4, the tunnel 11 is again shown extending between the peripheral wall 4 and the dividing wall 5. Castellated lower edges 19 are provided on the tunnel 11, enabling the tunnel to be supported on the base 3 with resulting apertures 20 providing ventilation of the interior of the tunnel 11. The apertures 20 are of similar height to the apertures 18 of FIG. 3.

Figure 4:
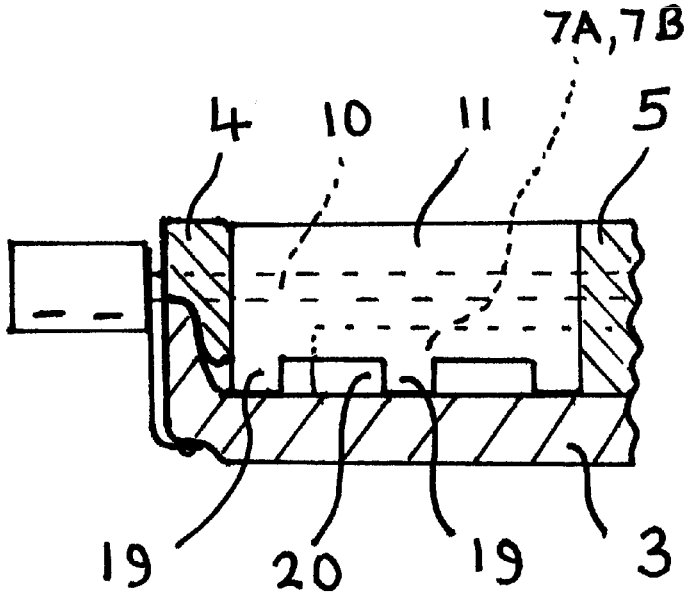
FIG. 4 is a detail showing a part-sectional view of an alternative embodiment of tunnel ventilation means in the radiant electric heater of FIG. 1.

With the arrangements of FIGS. 3 and 4, the tunnel 11 may be formed integrally with the peripheral wall 4 or the dividing wall 5, the latter being generally preferred.

Figure 5:
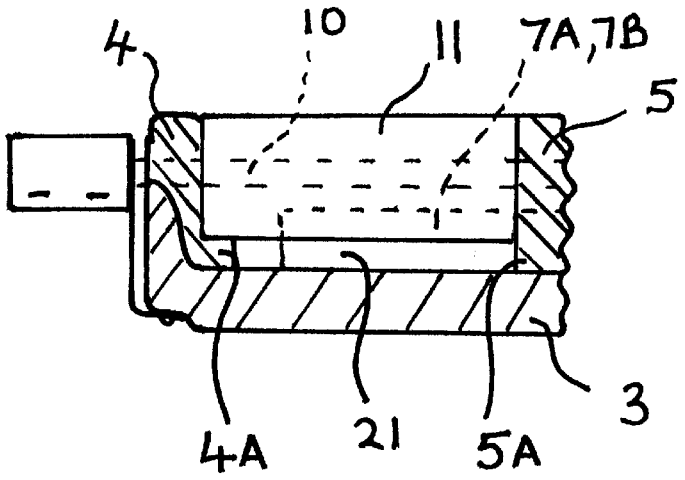
FIG. 5 is a detail showing a part-sectional view of a further embodiment of tunnel ventilation means in the radiant electric heater of FIG. 1.

Referring now to FIG. 5, the peripheral wall 4 and dividing wall 5 provide pedestal regions 4A, 5A which result in a stand-off of the tunnel 11 from the base 3. An aperture 21 is thereby formed between the lower edges of the tunnel 11 and the base 3, providing ventilation for the interior of the tunnel 11. The aperture 21 is of a similar height to the apertures 18 of FIG. 3.

As shown in FIG. 5, the tunnel 11 is integral with the dividing wall 5, pedestal 5A being effectively built into the integral construction. A ledge is formed at the base of the peripheral wall 4 and constituting the pedestal 4A which supports the outer end of the tunnel 11.

It will be appreciated by the skilled person in respect of any of the above-described embodiments that the peripheral wall 4 could be provided integral with the tunnel 11 additionally or alternatively to the dividing wall 5 being formed integral with the tunnel 11.

Alternatively, the tunnel 11 could be separate from both the peripheral wall 4 and the dividing wall 5 and both walls could be provided with pedestals in the form of ledges, as for the pedestal 4A.

Referring to FIG. 6, the inverted U-shaped tunnel 11 is supported on its lower edges 22 on the base 3. Ventilation for the interior of the tunnel 11 is provided either by means of grooves 23 in the surface of the base 3, extending under the lower edges 22 of the tunnel, or holes 24 tunnelling through the base 3, under the lower edges 22 of the tunnel 11. As explained above, the tunnel 11 could be provided integral with either of the peripheral wall 4 or the dividing wall 5, or could be separate from both the peripheral wall 4 and the dividing wall 5.

As shown in FIG. 1, the tunnel 11 is laterally extended in the vicinity of the peripheral wall 4 to form a cover 25 for the end portion 7A of the heating element 7 where it approaches the terminal block 14. The cover 25 could also be extended, if required, to overlie the other end portion 7B of the heating element 7. However this is not required in the arrangement shown in FIG. 1, where a relatively thick strip of metal 26 extends from the terminal block 14 to the end portion 7B of the heating element 7. The extension of the cover 25 over the end portion 7A or end portions 7A and 7B or the heating element 7 eliminates light from the end portion(s) of the heating element being observable by a user and hence improves the aesthetic appearance of the heater in use.

I claim:

1. A radiant electric heater comprising:

a base of thermal insulation material having supported relative thereto at least two concentrically-arranged heating elements separated by a dividing wall of thermal insulation material to form an outer heating zone and an inner heating zone, the heater having a peripheral wall of thermal insulation material;

a tunnel formed of thermal insulation material extending between the peripheral wall and the dividing wall across the outer heating zone and such that at least one heating element of the outer heating zone is substantially absent from an area occupied by the tunnel;

a rod-like temperature-responsive device extending from a periphery of the heater through the tunnel and at least partly across the inner heating zone, through an aperture provided in the dividing wall;

at least one portion of at least one heating element of the inner heating zone extending into the tunnel; and ventilation means provided for the tunnel intermediate the ends thereof to reduce temperature within the tunnel to a desired level.

2. A heater according to claim 1, wherein the ventilation means comprises at least one aperture extending into the tunnel from the outer heating zone.

3. A heater according to claim 2, wherein the at least one aperture is provided at a base region of side walls of the tunnel.

4. A heater according to claim 1, wherein the tunnel is of substantially inverted U-shaped cross section and supported on lower edges thereof.

5. A heater according to claim 4, wherein the tunnel is supported such that at least one aperture is provided between the tunnel and the base.

6. A heater according to claim 5, wherein the tunnel is supported on spaced-apart protrusions provided on the base.

7. A heater according to claim 6, wherein the protrusions are integral with the base.

8. A heater according to claim 5, wherein the tunnel has at least one lower edge of substantially castellated form.

9. A heater according to claim 5, wherein at least one pedestal region is formed by at least one lower region of the peripheral wall, the tunnel being spaced from the base at an end thereof by the at least one pedestal region.

10. A heater according to claim 5, wherein at least one pedestal region is formed by at least one lower region of the dividing wall, the tunnel being spaced from the base at an end thereof by the at least one pedestal region.

11. A heater according to claim 4, wherein at least one recess is provided in the base of thermal insulation material extending beneath at least one lower edge of the tunnel.

12. A heater according to claim 1, wherein the tunnel is integral with the dividing wall.

13. A heater according to claim 1, wherein the tunnel is integral with the peripheral wall.

14. A heater according to claim 1, wherein the tunnel comprises bound vermiculite.

15. A heater according to claim 1, wherein the at least one portion of the at least one heating element of the inner heating zone extends through the tunnel to a terminal region at the edge of the heater.

16. A heater according to claim 15, wherein the tunnel is provided with a laterally-extending portion proximate the peripheral wall to shield the at least one portion of the at least one heating element in the vicinity of the terminal region.

17. A heater according to claim 1, wherein the at least one heating element of the inner heating zone is energisable independently of the at least one heating element of the outer heating zone.

18. A heater according to claim 1, wherein the heating elements are of ribbon form.

19. A heater according to claim 18, wherein the heating elements are supported edgewise on the base.

20. A heater according to claim 1, wherein the base comprises microporous thermal and electrical insulation material.

* * * * *